US006653979B2

(12) United States Patent
Au et al.

(10) Patent No.: US 6,653,979 B2
(45) Date of Patent: Nov. 25, 2003

(54) ANTENNA FOR A PC CARD

(75) Inventors: Simon Au, Richmond (CA); Christopher Michael Chan-Henry, Vancouver (CA); Norman Toms, Vancouver (CA)

(73) Assignee: Sierra Wireless, Inc., Richmond (CA)

( * ) Notice: Subject to any disclaimer, the term of this patent is extended or adjusted under 35 U.S.C. 154(b) by 0 days.

(21) Appl. No.: 09/968,493

(22) Filed: Oct. 2, 2001

(65) Prior Publication Data

US 2003/0063035 A1 Apr. 3, 2003

(51) Int. Cl.[7] ..... H01Q 1/24
(52) U.S. Cl. ..... 343/702; 343/882
(58) Field of Search ..... 343/702, 715, 343/882, 900, 901; 455/90, 575; H01Q 1/24, 1/38

(56) References Cited

U.S. PATENT DOCUMENTS 5,644,320 A * 7/1997 Rossi ..... 343/702
5,828,346 A * 10/1998 Park ..... 343/826
5,973,645 A * 10/1999 Zigler et al. ..... 343/702
6,359,591 B1 * 3/2002 Mou ..... 343/702
6,259,418 B1 * 7/2002 Jones et al. ..... 343/846
6,266,017 B1 * 7/2002 Aldous ..... 343/702

FOREIGN PATENT DOCUMENTS

EP 05055817 5/1993 ..... H01Q/1/24
WO WO 01/71844 9/2001 ..... H01Q/1/24

* cited by examiner

*Primary Examiner*—Tho Phan
(74) *Attorney, Agent, or Firm*—Thelen Reid & Preist, LLP; Robert E. Krebs; Adrienne Yeung

(57) ABSTRACT

An antenna for a PC card is provided. The antenna of the present invention includes a shaft, a hinge and a nub. The shaft has a first end and a second end where the hinge is disposed intermediate the first end and the second end of the antenna at an angle relative to the PC card. The nub, which is disposed at the second end of the shaft, includes a gripping surface for gripping by a user during deployment of the antenna. The gripping surface is disposed at the angle relative to the hinge such that as a user rotates the antenna during deployment, the antenna properly deploys.

32 Claims, 7 Drawing Sheets

ANTENNA FOR A PC CARD

BACKGROUND OF THE INVENTION

1. Field of the Invention

The present invention relates generally to antennas for PC cards and more specifically, to an antenna configured for controlled deployment from a PC card.

2. Description of Related Art

Today, users reliance on wireless communication continues to steadily increase. This reliance includes the use of wireless communication with mobile devices such as laptop computers and personal data assistants (PDA). These mobile devices have the ability to send and receive data, such as files, facsimiles or the like, using wireless PC cards, such as wireless modems.

The PC cards which send and receive data typically include an internal modem and an antenna which provide communication capability for the PC card. The modem includes the necessary components for allowing data transmission. The antenna facilitates data transmission by the modem to a remote device. During inoperation of the PC card, the antenna remains in an undeployed configuration within the PC card. When a user desires to use the PC card for data transmission, a user deploys the antenna prior to data transmission by the modem and the PC card. Deployment of the antenna improves the data transmission capabilities of the PC card.

A user deploys the antenna by gripping an exposed end of the antenna and pulling the antenna away from both the PC card and the device which uses the PC card. As the user pulls the antenna away from the PC card, the user rotates the antenna into a vertical direction relative to the PC card to enhance data transmission capabilities. The prior art antennas include a hinge which allows rotation of an end of the antenna into a vertical direction. Typically, the exposed end includes a tip having indentations which allow a user the ability to pull on the antenna. However, the configuration of the indentations relative to the hinge of the antenna does not ensure proper deployment of the antenna from the PC card. To further illustrate, a user may rotate the antennae in a direction opposite to a range of motion of the hinge of the antenna which allows rotation. As a result, damage may occur to both the antenna and the PC card. For example, rotating the antenna in a direction opposite to the hinge may bend the antenna, thereby precluding use of the antenna. In addition, improper rotation of the antenna relative to the hinge may cause detachment of the antenna from the PC card, thereby limiting data transmission by the PC card.

Therefore, a need exists for an antenna having a configuration which ensures proper deployment of the antenna during use of a PC card having the antenna. This new antenna should allow proper deployment of the antenna regardless of the way a user grips the antenna during deployment of the antenna.

BRIEF SUMMARY OF THE INVENTION

The present invention fills the aforementioned needs by providing an antenna configured to allow proper deployment from PC card using the antenna. The configuration minimizes the possibility of damage to the antenna due to improper deployment of the antenna for data transmission by the PC card.

In one embodiment of the present invention, an antenna for a PC card is provided. The antenna includes a shaft having a first end and a second end; a hinge and a knub. The hinge is disposed intermediate the first end and the second end at an angle relative to the PC card. The knub, which is disposed at the second end of the shaft, includes a gripping surface, such as a dimple, for gripping by a user. The gripping surface is orientated at the angle relative to the hinge in order to allow proper deployment of the antenna during use of the PC card. The angle of the gripping surface relative to the hinge is such that as a user moves the knub via the gripping surface in a vertical direction with relation to the PC card, the antenna properly deploys.

In another embodiment of the present invention, an antenna assembly for a PC card is disclosed. The assembly includes a housing having a shaft, a hinge and a knub. The shaft within the housing includes a first end and a second end opposite the first end. The hinge, which is disposed intermediate the first end and the second end, is configured for rotating the second end of the antenna relative to the first end. In addition, the configuration of the hinge relative to the PC card allows for proper deployment of the antenna as a user rotates the second end of the antenna during antenna deployment. The assembly also includes a knub disposed about the second end of the antenna. The knub includes a gripping surface which is configured to allow a user to grip the surface during deployment of the antenna. The gripping surface is also disposed relative to the hinge such that as the user deploys the antenna, the antenna deploys in a proper configuration.

As may be appreciated, the present invention discloses a PC card antenna being configured to ensure proper deployment when a user desires to transmit data using the PC card. The configuration of the nub relative to the hinge and the PC card minimizes the possibility of damage to the antenna during deployment of the antenna.

BRIEF DESCRIPTION OF THE SEVERAL VIEWS OF THE DRAWINGS

Many advantages of the present invention will be apparent to those skilled in the art with a reading of this specification in conjunction with the attached drawings, wherein like reference numerals are applied to like elements and wherein.

DETAILED DESCRIPTION OF THE INVENTION

The present invention discloses an antenna for a PC card. As an overview, a configuration of an antenna in accordance with an embodiment of the present invention ensures proper deployment of the antenna during use of a PC card using the antenna for data transmission. The antenna includes a hinge disposed at an angle relative to the PC card. A gripping surface of the antenna is orientated at the angle relative to a hinge of the antenna. As will be discussed in greater detail with respect to the accompanying Figures, as a user grips and moves the gripping surface and the antenna, the orientation of the gripping surface relative to the hinge ensures proper deployment of the antenna.

Figure 1:
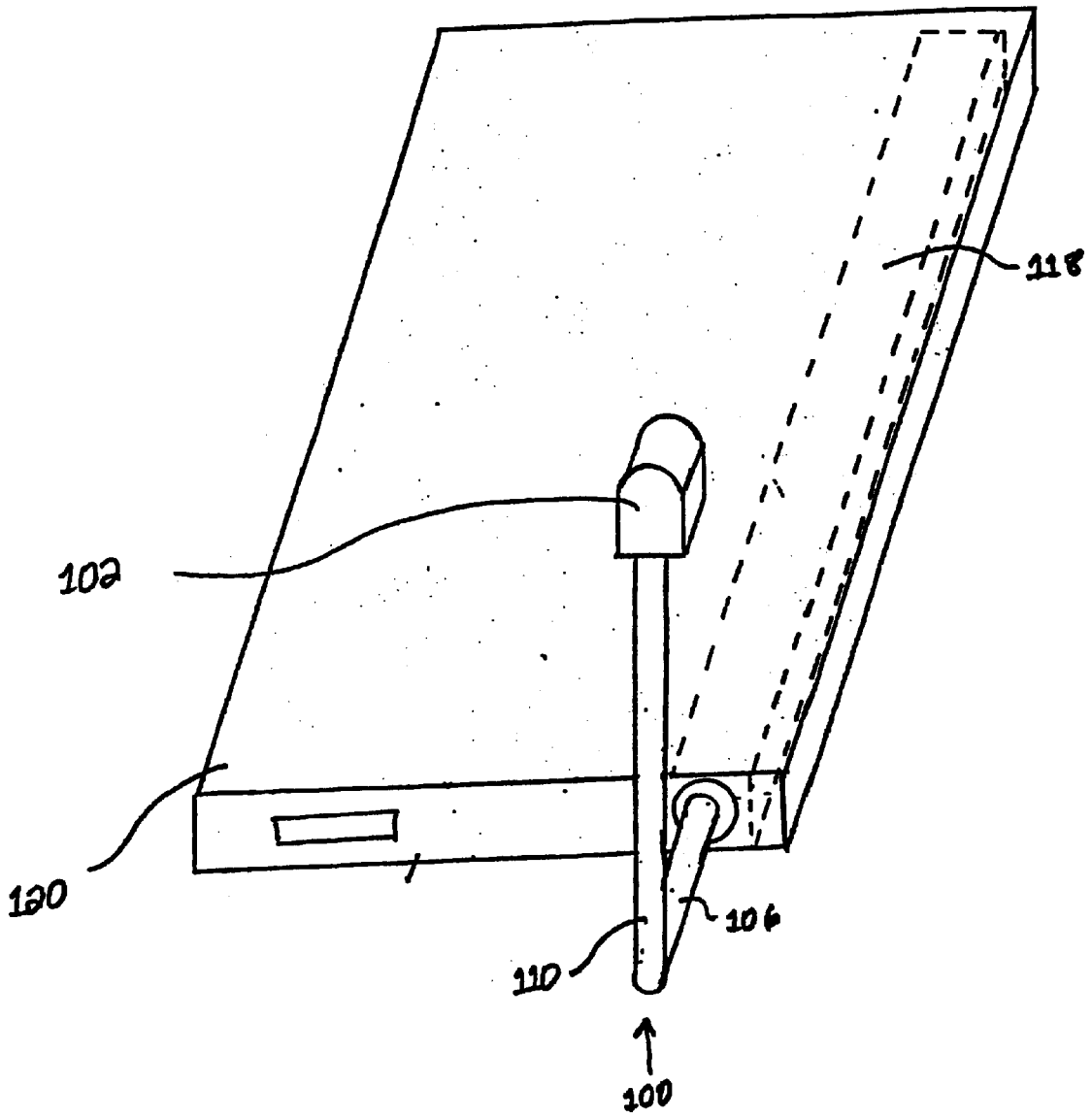
FIG. 1 shows a schematic of an antenna for a PC card in accordance with one embodiment of the present invention.

Now making reference to the Figures, and more particularly to FIG. 1, FIG. 1 shows a schematic of an antenna 100 for a PC card 120, in accordance with one embodiment of the present invention. As may be seen with reference to the Figure, the antenna 100 is in a deployed position such that the PC card 120 may send and receive data. When the antenna is in the deployed position as shown, the antenna maximizes data transmission by the PC card 120. When the PC card 120 is not transmitting data, the antenna 100 is in a undeployed position, as shown with reference to FIG. 2.

Figure 2:
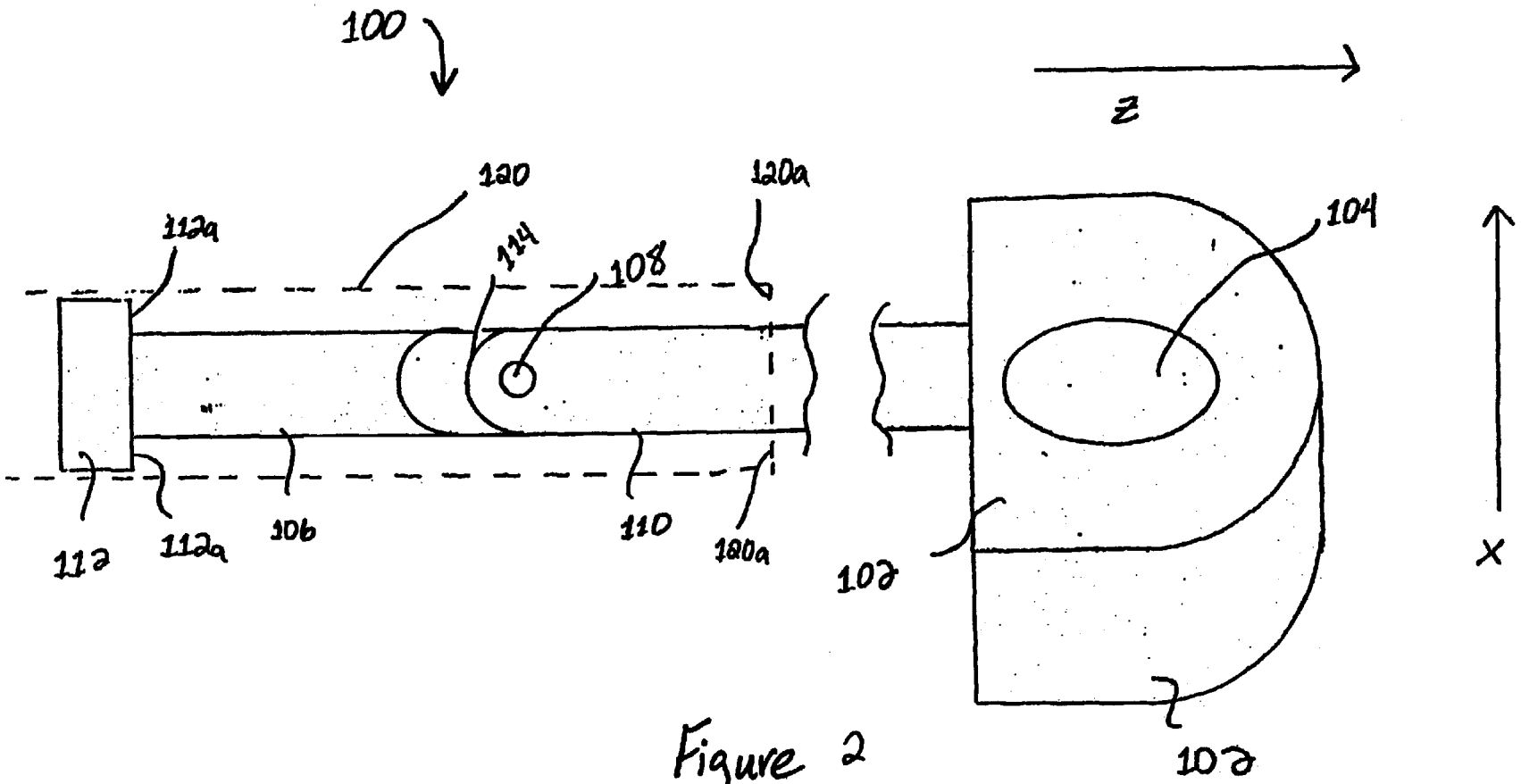
FIG. 2 is an embodiment of the present invention where the antenna shown with respect to FIG. 1 is in a stowed position within the PC card, also shown with reference to FIG. 1.
Figure 3:
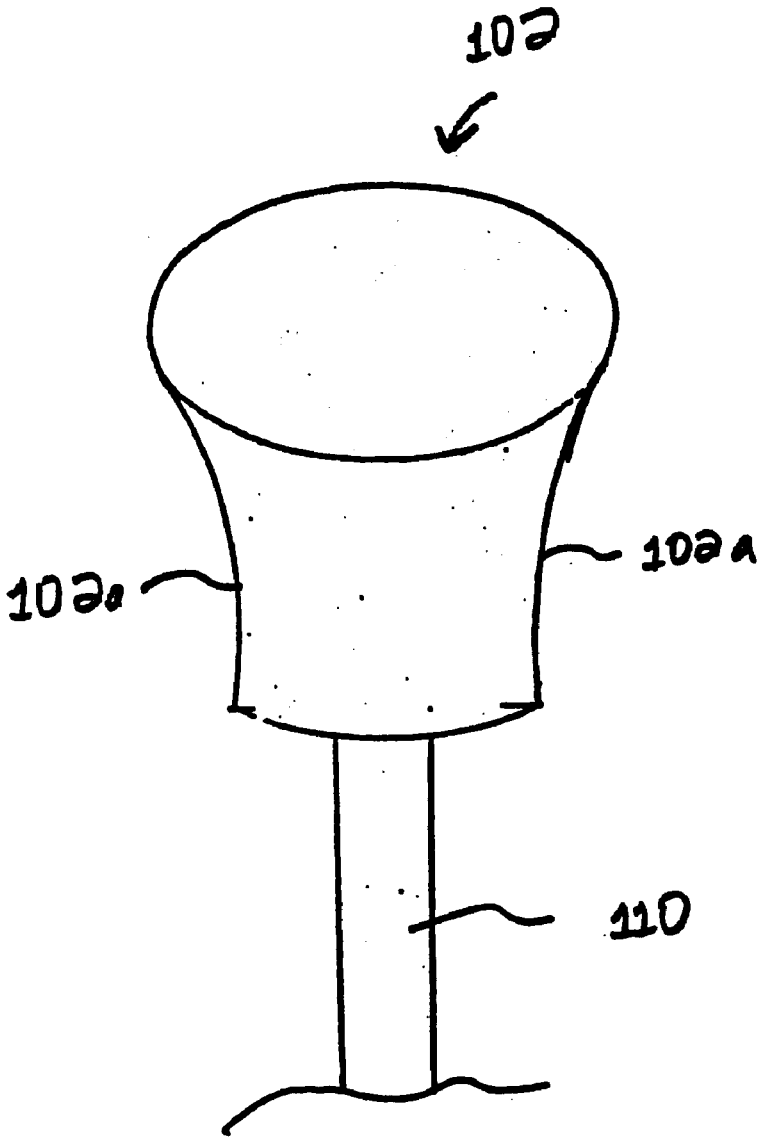
FIG. 3 illustrates a schematic of an alternative embodiment of the present invention where a nub of the antenna shown with reference to FIG. 1 has a bell configuration.

FIG. 2 is an embodiment of the present invention illustrating a schematic side view of the antenna 102 where the antenna 100 is stowed within the PC card 120 shown with reference to FIG. 1. As may be seen with reference to the Figure, the antenna 100 includes a nub 102, a dimple 104 within the nub 102, a first end 110 and a second end 106. In this embodiment, the PC card 120 may be any PC card having data transmission capabilities in a wireless environment, such as Type II unextended PC card, a Type II extended PC card, or the like. The nub 102 protrudes from the PC card 120 during stowage of the antenna 100. When a user desires to transmit data using the PC card 120, the user must first deploy the antenna 100. The user deploys the antenna 100 by pulling the nub 102 at the dimple 104 in a direction indicated by directional arrow Z. The dimple 104 may be any gripping surface which allows a user to grip the antenna 100, such as an indented surface within the nub 102, a serrated surface or the like. Likewise, the nub 102 may have a contoured configuration as shown with reference to FIG. 3. In the embodiment shown with reference to FIG. 3, the nub 102 includes a concavity 102*a* disposed about the periphery of the nub 102 to form the contoured configuration. Therefore, as a user deploys the antenna, the user grips the nub 102 of the antenna 100 about the concavity 102*a*.

Returning to FIG. 2 and the antenna 100, a user pulls on the nub 102 until a surface 112*a* of an end 112 of the antenna contacts a surface 120*a* of the PC card 120. Once the surface 112*a* contacts the surface 120*a*, the user moves the nub 102 in upward direction indicated by directional arrow X. When the user moves the nub 102 as indicated by the directional arrow X, the antenna moves.into the deployed position shown with reference to FIG. 1. The antenna 100 moves into the deployed position with a hinge 114 having a pin 108. During operation, the hinge 114 rotates about the pin 108, thereby allowing deployment of the antenna 100 into the deployed position. The antenna moves into the configuration shown with reference to FIG. 1 since the pin 108 is disposed at a given angle relative to the PC card 120, as shown in greater detail with reference to FIG. 4A.

Figure 4A:
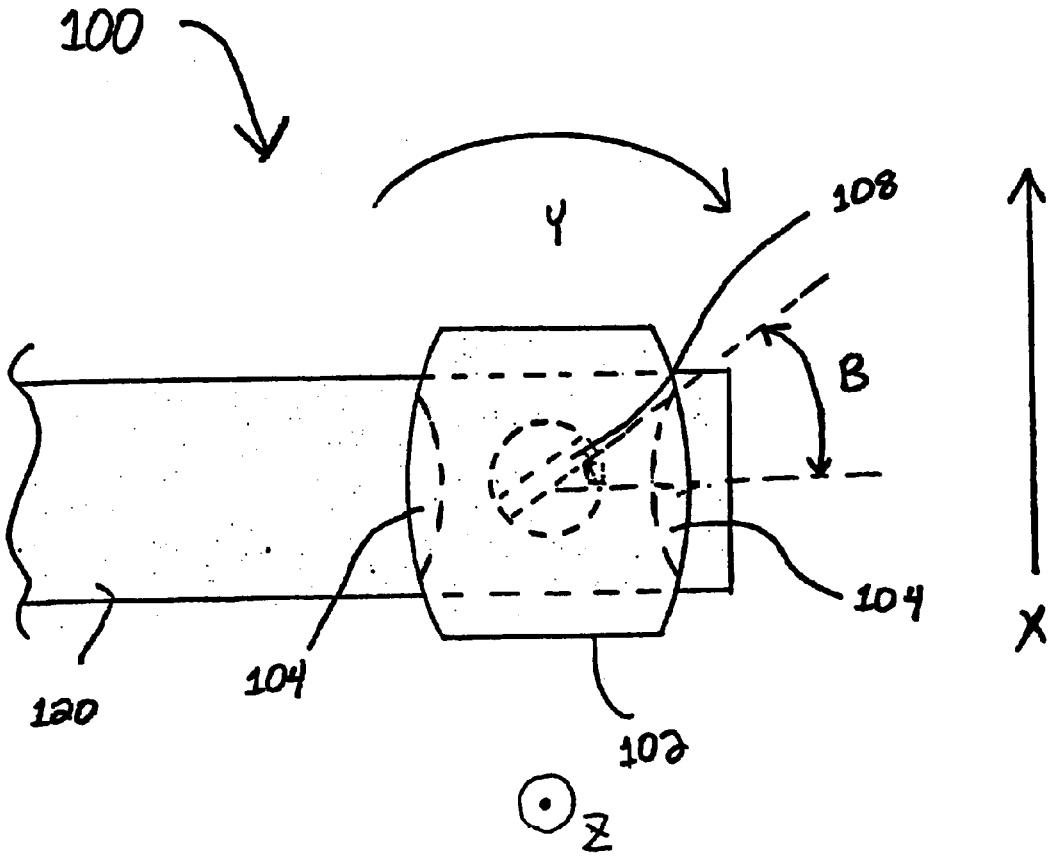
FIG. 4A is a schematic of an embodiment of the present invention illustrating the nub shown with reference to FIG. 2.
Figure 4B:
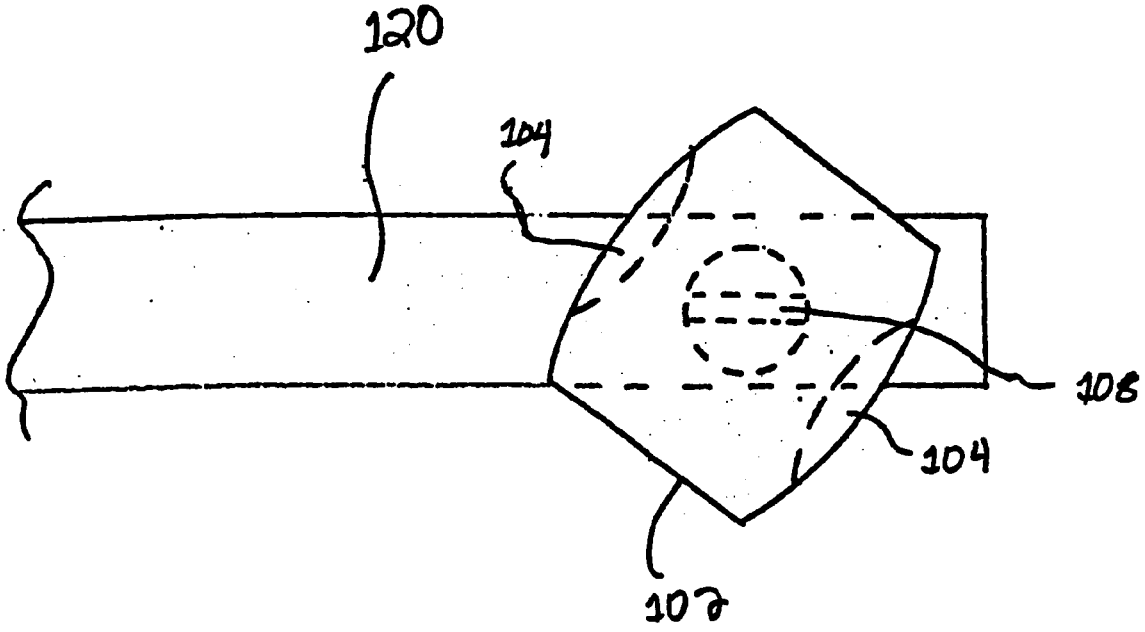
FIG. 4B illustrates a schematic of the present invention showing the nub of FIG. 4A during deployment of the antenna shown with reference to FIG. 1.

FIG. 4A is a schematic front view of the antenna 100 shown with reference to FIG. 2 in accordance with an embodiment of the present invention. As may be seen with reference to the Figure, the pin 108 is disposed at an angle B relative to the PC card 120. In one embodiment of the present invention, the angle B is preferably in a range between about 5 degrees and about 85 degrees, more preferably in a range between about 25 degrees and about 65 degrees and most preferably about 45 degrees. When a user moves the nub 102 in the direction indicated by the directional arrow Z, the antenna 100 and the nub 102 rotate in a direction indicated by directional arrow Y. As the antenna 100 rotates in the direction indicated by the directional arrow Y, the antenna 100 is placed such that it can deploy into the proper position shown with reference to FIG. 1. It should be understood that when the nub 102 has the gripping surface 104 disposed at an angle relative to the pin 108 as a user moves the nub 102 in a direction indicated by the directional arrow Z, the nub 102 rotates in the direction indicated by the directional arrow Y, ensuring proper deployment of the antenna 100. The antenna rotates as indicated by the directional arrow Y until the pin 108 is in the proper orientation as shown with reference to FIG. 4B. As may be seen with reference to FIG. 4B, the pin 108 is in the proper orientation when the pin 108 is parallel to the PC card 120. It should be noted that the pin 108 forms a portion of the hinge 114, therefore the hinge 114 is also disposed at the angle B relative to the PC card 120. In addition, the hinge 114 is parallel to the PC card 120 when the pin 108 is in the proper orientation. Upon orientation of the hinge 114 and the pin 108 as shown with reference to FIG. 4B, the antenna 100 deploys into the position shown with reference to FIG. 1.

Figure 5:
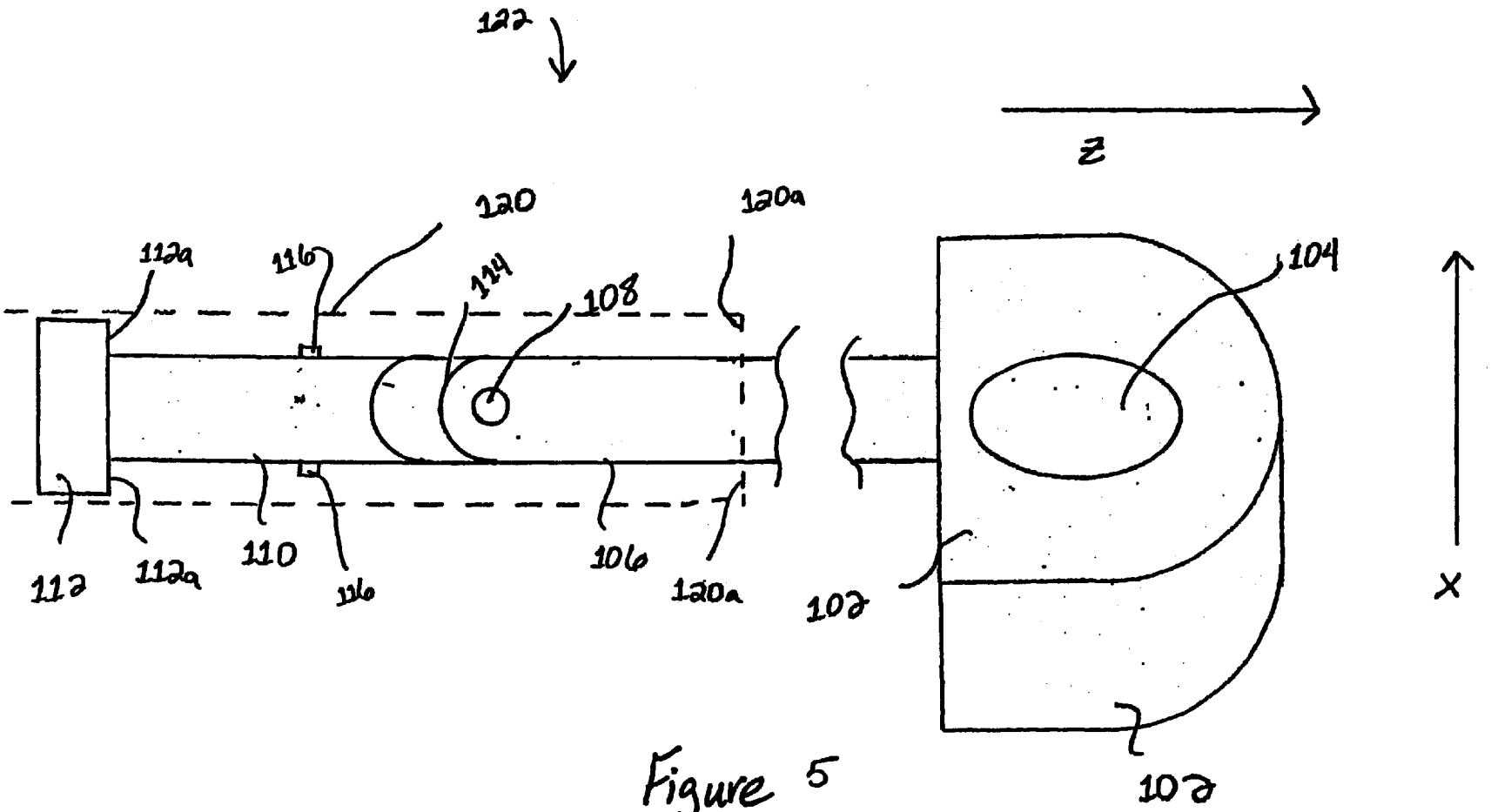
FIG. 5 illustrates an alternative embodiment of the present invention where the antenna shown with reference to FIG. 2 includes pins.
Figure 6:
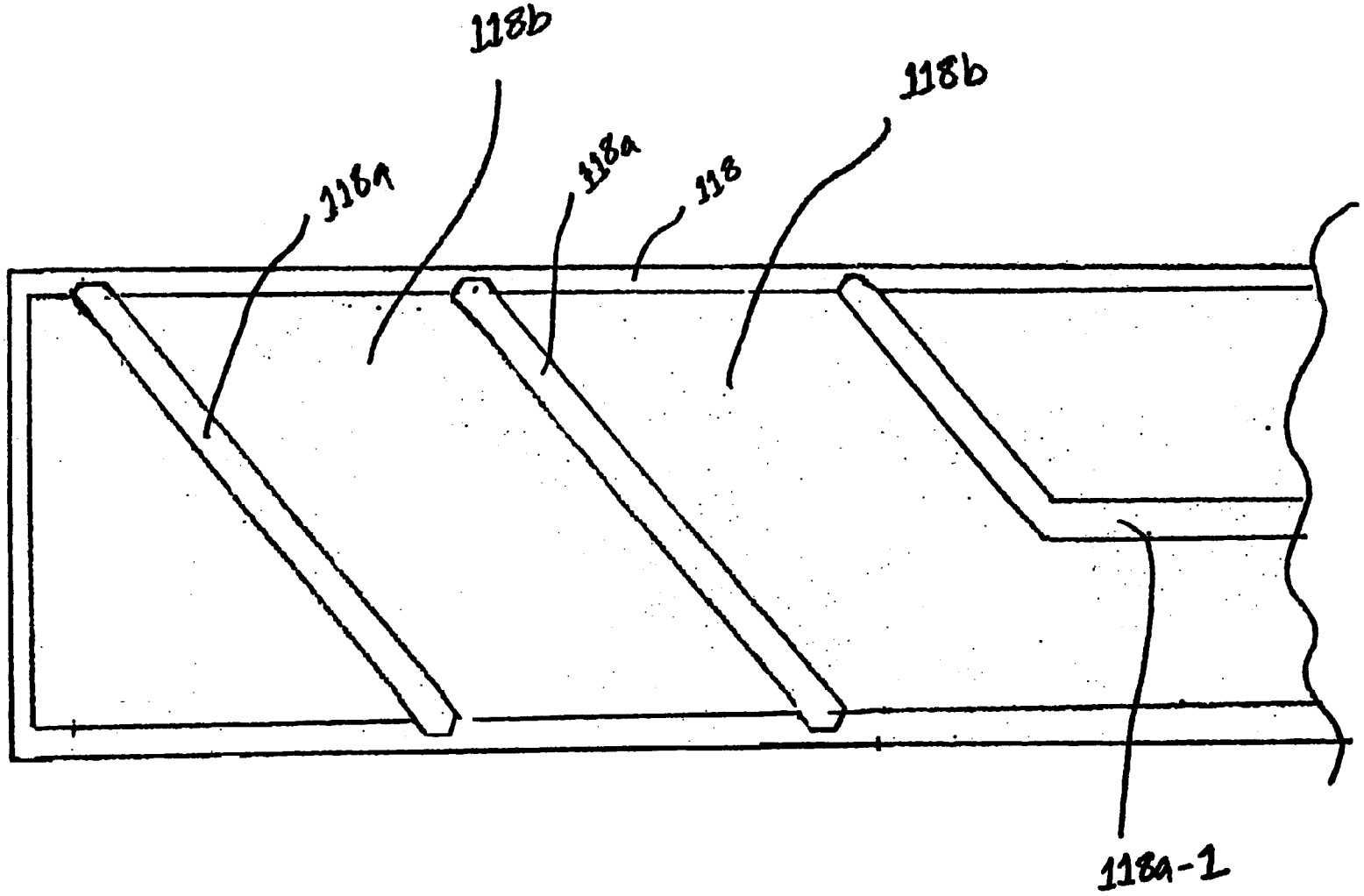
FIG. 6 is a cross-sectional view of an antenna housing in accordance with one embodiment of the present invention.

Now turning attention to FIG. 5, FIG. 5 illustrates an alternative embodiment of the present invention where the antenna 100 shown with reference to FIG. 2 includes pins 116 within an assembly 122. The pins 116 are disposed about a periphery of the first end 110 of the antenna 100 such that the pins 116 control rotation of the antenna 100 as a user pulls on the nub 102. The pins 116 control the rotation of the antenna 100 by traveling through a guide 118*a* of an antenna housing 118, as shown with reference to FIG. 6. FIG. 6 is a cross-sectional view of the antenna housing 118 shown with reference to FIG. 2 in accordance with one embodiment of the present invention. As may be seen with reference to FIG. 6, the guide 118*a* is a groove radially disposed within an inner wall 118*b* of the antenna housing 118. As a user deploys the antenna 100 by pulling on the nub 102, the pins 116 travel through the guide 118*a*, thereby rotating the antenna 100 and the hinge 114 along with the pin 108 into the orientation for deployment as shown with reference to FIG. 4B. Once the antenna 100 is in the proper orientation for deployment, the pins 116 travel within guide portion 118*a*-1 of the guide 118 in order to maintain the orientation. The guide portion 118*a*-1 maintains the proper orientation until the surface 112*a* of the antenna 100 contacts the surface 120*a* of the PC card 120, whereby the antenna 100 deploys into the position shown with reference to FIG. 1, as previously described.

As may be appreciated, the present invention provides an antenna configured to ensure proper deployment from a PC card. The present invention avoids the problems of the prior art since a user is precluded from bending the antenna in a direction opposite a hinge of the antenna. As previously discussed, bending of prior art antennas increased the possibility of detachment of the antenna from the PC card. As such, overall reliability of a PC card using the present invention increases.

The above are exemplary modes of carrying out the invention and are not intended to be limiting. It will be apparent to those of ordinary skill in the art that modifications thereto can be made without departure from the spirit and scope of the invention as set forth in the accompanying claims.

What is claimed is:

1. An antenna for a PC card, the antenna comprising:

a shaft having a first end and a second end;

a hinge disposed between the first end and the second end, said hinge being placed at a first angle relative to the PC card when the antenna is in a first position housed in the PC card; and a nub disposed at the second end of said shaft, said nub having at least one gripping surface for gripping by a user, the gripping surface being orientated at a second angle relative to said hinge such that as the user pulls the antenna to a second position for deployment, the pulling movement of the nub causes rotation of said shaft such that said hinge is placed into a proper angle for deployment.

2. An antenna as recited in claim 1, wherein the first angle is about 45 degrees.

3. An antenna as recited in claim 1, wherein the gripping surface has a contoured configuration.

4. An antenna as recited in claim 1, wherein the gripping surface is a dimple formed within the nub.

5. An antenna as recited in claim 1, wherein the antenna deploys properly when the antenna is an orientation which allows maximum data transmission by the PC card.

6. An antenna as recited in claim 1, wherein the second angle is about 45 degrees.

7. An antenna as recited in claim 1, wherein said hinge placed at the proper angle for deployment is substantially parallel to the PC card.

8. An antenna assembly for a PC card, the antenna assembly comprising:

a shaft having a first end and a second end;

a housing rotatably holding said shaft;

a hinge disposed between the first end and the second end of said shaft, said hinge being placed at a first angle relative to the PC card when the antenna is in a first position; and a nub disposed about the second end of said shaft, the nub including at least one gripping surface, the gripping surface being configured to allow the user to grip the surface for deployment of the antenna, the gripping surface being oriented at a second angle relative to said hinge such that as the user pulls the antenna to a second position for deployment, the pulling movement of said nub causes rotation of said shaft such that said hinge is placed into a proper angle for deployment.

9. An antenna assembly as recited in claim 8, wherein the antenna deploys in a proper configuration when the antenna is an orientation which allows maximum data transmission by the PC card.

10. An antenna assembly as recited in claim 8, wherein the gripping surface is a dimple formed within the nub.

11. An antenna assembly as recited in claim 8, wherein the gripping surface has a contoured configuration.

12. An antenna assembly as recited in claim 8, wherein the first angle is about 45 degrees.

13. An antenna assembly as recited in claim 8, wherein the second angle is about 45 degrees.

14. An antenna assembly as recited in claim 8, wherein said hinge placed at the proper angle for deployment is substantially parallel to the PC card.

15. An antenna assembly as recited in claim 8, wherein said housing includes:

a guide disposed within an inner wall of the housing, the guide being configured to control rotation of said shaft of the antenna as the user pulls said shaft from the first position to the second position.

16. An antenna assembly as recited in claim 15, wherein said shaft includes:

pins radially disposed about said shaft, the pins being configured for engagement with the guide of said housing such that as the user pulls said shaft from said housing, said shaft rotates as the pins engage with the guide.

17. An antenna for a PC card, the antenna comprising:

a shaft including a first portion having a first end and a second portion having a second end;

a hinge coupling the first portion and the second portion, said hinge having a pin allowing the second portion to rotate therearound into a deployed configuration of said shaft, the pin being oriented at a first angle relative to the PC card when the antenna is in a first position housed in the PC card; and a nub disposed at the second end of said, said nub having at least one gripping surface to be gripped by a user, the gripping surface being orientated at a second angle relative to the pin of said hinge such that as the user pulls the antenna to a second position for deployment, the pulling movement of the nub causes rotation of said shaft such that the pin is positioned into a proper angle for deployment.

18. An antenna as recited in claim 17, wherein the first angle is about 45 degrees.

19. An antenna as recited in claim 17, wherein the second angle is about 45 degrees.

20. An antenna as recited in claim 17, wherein the pin of said hinge placed at the proper angle for deployment is substantially parallel to the PC card.

21. An antenna as recited in claim 20, wherein the portion of said shaft including the second end is positioned substantially vertical to the PC card in the deployed configuration.

22. An antenna as recited in claim 17, wherein the gripping surface is substantially vertical to the PC card when the antenna is in the first position.

23. An antenna as recited in claim 22, wherein the gripping surface of the antenna in the second position is at the second angle relative to the gripping surface of the antenna in the first position.

24. An antenna as recited in claim 17, wherein the gripping surface is a dimple formed within the nub.

25. An antenna as recited in claim 17, wherein the antenna deploys properly when the antenna is an orientation which allows maximum data transmission by the PC card.

26. An antenna assembly for a PC card, the antenna assembly comprising:

a shaft including a first portion hacing a first end and a second portion having a second end;

a hinge coupling the first portion and the second portion, said hinge having a pin allowing the second portion to rotate therearound into a deployed configuration of the shaft, the pin being oriented at a first angle relative to the PC card when the antenna is in a first position housed in the PC card;

a nub disposed at the second end of said shaft, said nub having at least one gripping surface to be gripped by a user, the gripping surface being orientated at a second angle relative to the pin of said hinge such that as the user pulls the antenna to a second position for deployment, the pulling movement of the nub causes rotation of said shaft such that the pin is positioned into a proper angle for deployment; and a housing rotatably holding said shaft.

27. An antenna assembly as recited in claim 26, wherein said housing includes:

a guide disposed within an inner wall of said housing, said guide being configured to control rotation of said shaft as the user pulls said shaft from within said housing.

28. An antenna assembly as recited in claim 27, wherein said shaft further includes:

pins radially disposed about said shaft, said pins being configured to engage with said quide as the user pulls said shaft from said housing.

29. An antenna assembly as recited in claim 28, wherein said pins are disposed near the first end of said shaft.

30. An antenna assembly as recited in claim 26, wherein the first angle is about 45 degrees.

31. An antenna assembly as recited in claim 26, wherein the second angle is about 45 degrees.

32. An antenna assembly as recited in claim 26, wherein said hinge placed at the proper angle for deployment is sunstantially parallel to the PC card.

* * * * *

UNITED STATES PATENT AND TRADEMARK OFFICE

CERTIFICATE OF CORRECTION

PATENT NO. : 6,653,979 B2 
DATED : November 25, 2003
INVENTOR(S) : Simon Au, Christopher Michael Chan-Henry and Norman Toms It is certified that error appears in the above-identified patent and that said Letters Patent is hereby corrected as shown below:

Column 2,
Lines 1, 3, 9, 14, 22 and 23, replace “knub” with -- nub --.

Column 6,
Line 17, replace “said,” with -- said shaft, --.
Line 49, replace “hacing” with -- having --.

Column 7,
Line 7, replace “quide” with -- guide --.

Column 8,
Line 7, replace “sunstantially” with -- substantially --.

Signed and Sealed this

Thirteenth Day of April, 2004

JON W. DUDAS
*Acting Director of the United States Patent and Trademark Office*